US005873314A

United States Patent [19]

Gamano et al.

[11] Patent Number: 5,873,314

[45] Date of Patent: Feb. 23, 1999

[54] BUTTON HOLER SEWING MACHINE

[75] Inventors: Jun Gamano, Okazaki; Hideo Ando, Kounan; Akihiro Funahashi, Handa, all of Japan

[73] Assignee: Brother Kogyo Kabushiki Kaisha, Nagoya, Japan

[21] Appl. No.: 919,116

[22] Filed: Aug. 28, 1997

[30] Foreign Application Priority Data

Aug. 28, 1996 [JP] Japan ..... 8-226384
Aug. 28, 1996 [JP] Japan ..... 8-226385

[51] Int. Cl.[6] ..... D05B 3/08; D05B 21/00

[52] U.S. Cl. ..... 112/66; 112/68; 112/73; 112/447

[58] Field of Search ..... 112/65, 66, 68, 112/70, 73, 447, 475.25

[56] References Cited

U.S. PATENT DOCUMENTS 5,125,349 6/1992 Koie et al. ..... 112/66
5,222,440 6/1993 Koie et al. ..... 112/68

*Primary Examiner*—Peter Nerbun
*Attorney, Agent, or Firm*—Oliff & Berridge PLC

[57] ABSTRACT

A sewing machine is provided with an X-correction value input unit that corrects, in an X-direction, seam position with respect to a position of an opening, e.g., a circular hole, formed in a workpiece cloth by an opening forming mechanism, and an X-direction seam data correction unit that corrects seam data based on an X correction value inputted from the X-correction value input unit. The sewing machine can also be provided with an Y-correction input unit and a Y-direction seam data correction unit for correcting Y-direction information in the seam data. With the seam data corrected by the seam data correction units, a seam position can be corrected with respect to the position of the opening formed by the opening forming mechanism. The sewing machine is also provided with a stitch width correction input unit that is used for inputting a correction value of a stitch width of the seam, and a seam data correction unit that corrects the seam data based on the stitch width of the seam input by the stitch width correction input unit. The stitch width changes when the seam is stitched with the corrected seam data.

19 Claims, 13 Drawing Sheets

BUTTON HOLER SEWING MACHINE

BACKGROUND OF THE INVENTION

1. Field of the Invention

The present invention relates to a button holer sewing machine capable of forming a button hole seam in a workpiece cloth set on a feed bar by horizontally moving the feed bar and vertically moving a needle bar up and down with an electric motor.

2. Description of the Related Art

There has been known a button holer sewing machine including a lower knffe and an upper hammer. The lower knife is positioned below the upper surface of the feed bar and retracted a predetermined distance behind a needle bar of the sewing machine. The hammer is provided above the lower knife so as to be pivotally movable toward the knife. When a workpiece cloth is set on the feed bar of the sewing machine and the start switch of the sewing machine is pressed, then the hammer pivots against the cloth so that the knife cuts a hole in the workpiece cloth. Next, the feed bar is moved frontwardly a distance determined by the above-described predetermined distance minus the sewing length, that is, the length of the button hole to be sewn. At this point, the sewing machine is started up. Next, the feed bar is moved in synchronization with vertical movements of the needle bar. The needle bar is pivoted in predetermined amounts. That is, when the needle bar is descending, it is alternately brought to an outer stitch position and an inner stitch position so that a desired hole seam is sewn.

Button holer sewing machines are capable of forming button hole seams using two methods: the first type is called the cut-first method, wherein sewing is performed after the hole is opened, and the second type is called the cut-last method, wherein the hole is opened after sewing is performed. A user selects the type of sewing method most appropriate to the user's need. When the cut-first method is used, seam data is prepared so as to stitch slightly inner side portions of the hole. On the other hand, when the cut-last method is used, seam data is prepared so as to stitch slightly outer side portions of the hole.

With the conventional button holer sewing machines, when the stitch width is to be changed, the pivotal amount of the needle bar between the inner stitch position and the outer stitch position is changed. It takes time even for a skilled worker to change the pivotal amount of the needle bar. Therefore, changing the stitch width lowers working efficiency.

Further, with conventional button holer sewing machines having a knife and hammer configuration, the lower knife must be frequently replaced to change the hole shape in accordance with the product to be produced. However, when the lower knife is attached with poor precision, holes are not opened at the ideal position with respect to the seam. The resultant button holes have a poor appearance. When the cut-last method is used, in the worst situation, the seams can be cut by the knife, thereby ruining the finished product. For this reason, the attachment of the lower knife must be performed by a skilled worker and with great care, which is troublesome.

SUMMARY OF THE INVENTION

It is an object of the present invention to overcome the above-described problems and to provide a button holer sewing machine capable of producing attractive seams without the troublesome operations of precisely replacing the lower knife.

It is another object of the present invention to provide a button holer sewing machine capable of easily changing a stitch width with simplified operations.

To achieve the above and other objects, the present invention is applied to a button holer sewing machine which includes a feed bar on which a workpiece cloth is set, an opening forming mechanism, a needle bar to which a needle is attached, and a looper base provided with a looper. The feed bar is movable horizontally on an X-Y plane defined by an X direction and a Y direction perpendicular to the X direction. The opening forming mechanism includes a blade and a hammer for forming an opening at a position in the workplece cloth. The needle bar and said needle are generally vertically movable from an upper position to a lower position. A seam is formed in the workpiece cloth by said looper and said needle in cooperation with each other. A feed mechanism is provided that moves the feed bar on the X-Y plane when the needle bar is in its upper position. A drive mechanism is also provided that simultaneously drives the needle bar and the looper to perform seam forming operations. A rotation mechanism is further provided that rotates the needle bar and the looper base about a vertical axis. A control device is provided that controls the rotation mechanism, the feed mechanism and the drive mechanism based on seam data designating, for each stitch, a rotation angle of the needle bar and the looper base, and a feed amount of the feed bar represented by an X value and Y value on the X-Y plane.

According to one aspect of the invention, there are provided an X-correction value input unit for inputting an X-correction value, and a seam data correction unit that corrects the seam data based on at least the X correction value input by the X-correction value. With the stitch data corrected by the seam data correction unit, a seam position in the X-direction can be corrected with respect to the position of the opening formed by the opening forming mechanism. A Y-correction value input unit may be further provided that inputs a Y-correction value. In this case, the seam data correction unit corrects the seam data based further on the Y correction value input by the Y-correction value.

The button holer sewing machine described above includes a motor, a main shaft rotated by the motor, and a pivot mechanism including a cam mechanism that is connected to the needle bar. The cam mechanism translating rotations of the main shaft to a pivotal movement, causing the needle to pivotally move between inner and outer positions on the X-Y plane with respect to a boundary of the circular hole.

There is provided a stitching information input unit for inputting basic information that defines the seam to be formed in the workpiece cloth. A seam data producing unit is also provided that produces the seam data based on the basic information input by the stitching information input unit.

The stitching information input unit and the X-correction value input unit may be formed as a single unit. If the Y-correction value input unit is provided, the stitching information input unit, the X-correction value input unit, and the Y-carrection value input may be formed as a single unit.

The blade is detachably provided, thereby allowing any one of different shape openings to be formed on the workpiece cloth. When the opening formed in the workplace cloth by the opening forming mechanism is a circular hole, the basic information input by the stitching information input means includes a diameter of the circular hole, peripheral stitch number indicating number of stitches formed along a periphery of the circular hole, and overlap stitch number indicating number of stitches overlapped in the periphery of the circular hole. In this case, the seam data producing unit produces the seam data defined by:

$$X<j>=(A/2)\times\cos\{(2j-2)\times T\}$$

$$Y<j>=(A/2)\times\sin\{(2j-2)\times T\}$$

$$\theta<j>=(2j-2)\times T$$

$$X(j)=(A/2)\times\cos\{(2j-1)\times T\}$$

$$Y(j)=(A/2)\times\sin\{(2j-1)\times T\}$$

$$\theta(j)=(2j-1)\times T$$

wherein X<j> represents an X coordinate value on the X-Y plane of the inner position corresponding to a stitch number j, Y<j> represents a Y coordinate value on the X-Y plane of the inner position corresponding to the stitch number j, θ <j> represents a rotation angle of the needle bar and the looper base corresponding to the stitch number j when the inner position is stitched, X(j) represents an X coordinate value on the X-Y plane of the outer position corresponding to the stitch number j, Y(j) represents a Y coordinate value on the X-Y plane of the outer position corresponding to the stitch number j, θ (j) represents a rotation angle of the needle bar and the looper base corresponding to the stitch number j when the outer position is stitched, A represents a diameter of the circular hole, and T is a rotation angle of the needle bar and the looper base for stitching the inner position and the outer position corresponding to one stitch number. Values of X<j>, Y<j>, X(j), Y(j), and ϵ(j) are stored in a memory. The X-correction value input unit adds the X-correction value to each of the values of X<j> and X(j) corresponding to an initial stitch number, and the Y-correction value input unit adds the Y-correction value to each of the values of Y<j> and Y(j) corresponding to the initial stitch number. The seam data corrected by the seam data correction unit is also stored in the memory.

According to another aspect of the invention, there is provided in the button holer sewing machine of the type described above a stitch width correction input unit that inputs a correction of a stitch width of the seam determined by the inner and outer positions to which the needle pivotally moves, and a seam data correction unit that corrects the seam data based on the stitch width of the seam input by the stitch width correction input unit.

When the circular hole is formed in the workpiece cloth, the seam data correction unit produces corrected seam data represented by $$X(j)=\{(A/2)+D\}\times\cos\{(2j-1)\times T\}$$

$$Y(j)=\{(A/2)+D\}\times\sin\{(2j-1)\times T\}$$

wherein D represents the stitch width input by the stitch width correction input unit.

The stitch width can be corrected when forming a seam in a button hole having another configuration, such as an eyelet button hole.

BRIEF DESCRIPTION OF THE DRAWINGS

The above and other objects, features and advantages of the invention will become more apparent from reading the following description of the preferred embodiment taken in connection with the accompanying drawings in which:

FIG. 4(*b*) is a plan view showing a control panel of the sewing machine used for a second embodiment of the present invention;

FIG. 4(*c*) is a plan view showing a control panel of the sewing machine used for a third embodiment of the present invention;

FIG. 5(*b*) is a flowchart representing a routine performed by the control device of the sewing machine according to the second embodiment of the present invention;

FIG. 5(*c*) is a flowchart representing a part of the routine performed by the control device of the sewing machine according to the third embodiment of the present invention;

FIG. 5(*d*) is a flowchart representing a remaining part of the routine perfcrmed by the control device of the sewing machine according to the third embodiment of the present invention;

DETAILED DESCRIPTION OF THE PREFERRED EMBODIMENTS

Figure 1:
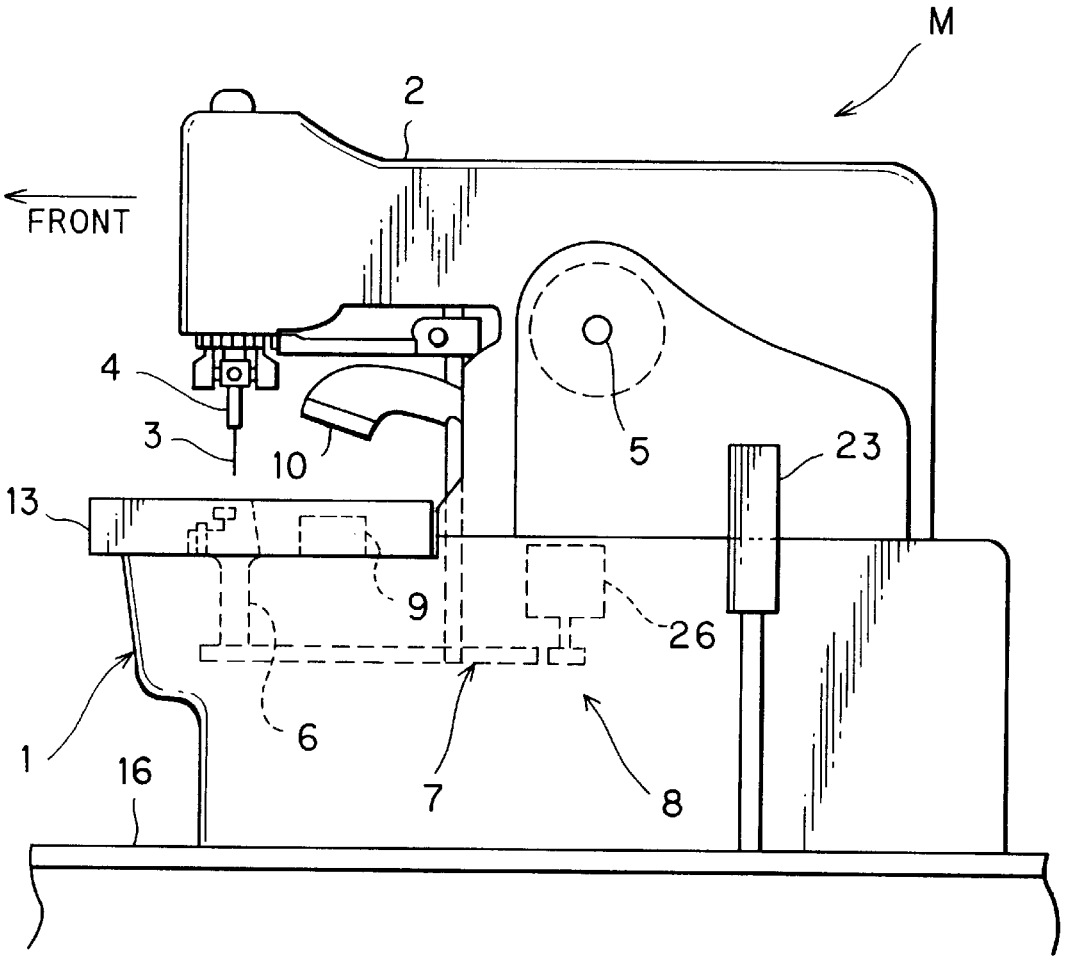
FIG. 1 is a side view showing a button holer sewing machine according to a preferred embodiment of the present invention.

A button holer sewing machine according to a preferred embodiment of the present invention will be described while referring to the accompanying drawings. In the following description of the various embodiments, like reference numerals refer to like parts throughout to omit duplicate description. The expressions "front", "rear", "above", "below", "right" and "left" are used throughout the description to define the various parts when the sewing machine is disposed in an orientation in which it is intended to be used.

As shown in FIG. 1, a button holer sewing machine M according to the present embodiment includes a rectangular box-shaped bed portion 1, and an arm portion 2 integrally formed with the bed portion 1. The arm portion 2 extends from the rear portion of the bed portion 1 upward and over the bed portion 1.

Figure 2:
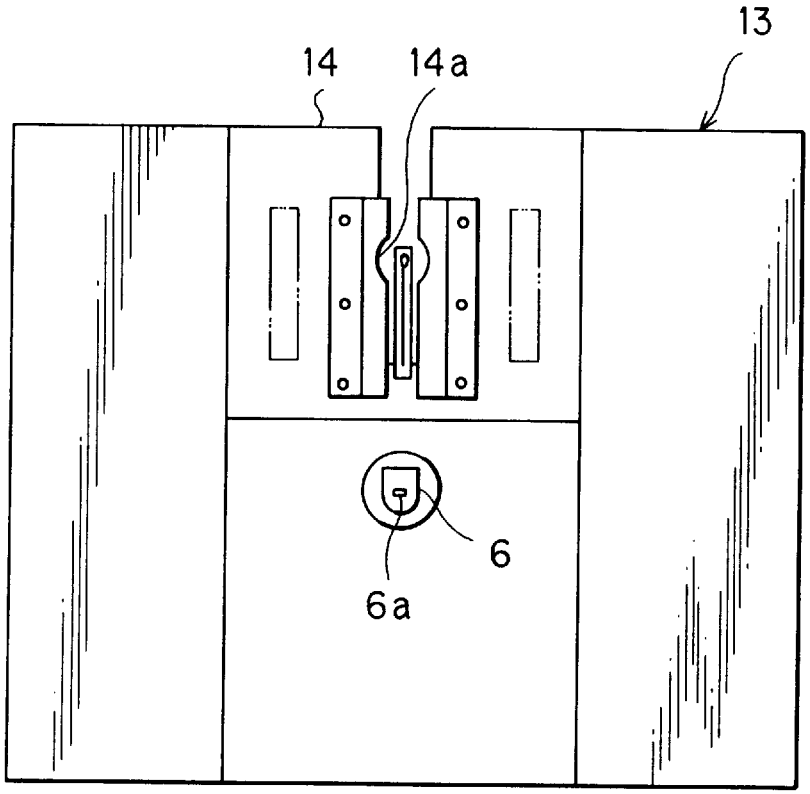
FIG. 2 is a plan view showing a feed bar of the sewing machine.

The needle bar 4 has a sewing needle 3 and is provided to the lower tip of the arm portion 2 so as to be generally movable in the vertical direction. A main shaft 5 is provided so as to be rotated by the sewing machine motor 24. Although not shown in the drawings, a cam mechanism is provided for transmitting rotational force from the main shaft 5 to drive vertical movement of the needle bar 4 while driving the needle bar 4 leftward and rightward by a predetermined amplitude. In the following embodiments, one turn of the main shaft 5 drives the needle bar 4 to rise and drop twice at the leftside swing position and twice at the rightside swing position. A looper base 6 is provided in the bed portion 1. The looper base 6 is shown in FIG. 2 where only one looper is shown. In actuality, however, the looper base 6 includes two loopers 6*a* in confrontation with the needle bar 4. The two loopers 6*a* are driven by rotation of the main shaft 5 in synchronization with vertical movement of the needle bar 4 via the cam mechanism (not shown in the drawings).

A pivot mechanism 8 is provided in the bed portion 1. The pivot mechanism 8 includes a θ direction motor 26, formed from a stepping motor, and a gear mechanism 7. The pivot mechanism 8 serves to integrally pivot the needle bar 4 and the looper base 6 in a horizontal plane and around a vertical axis.

Figure 3:
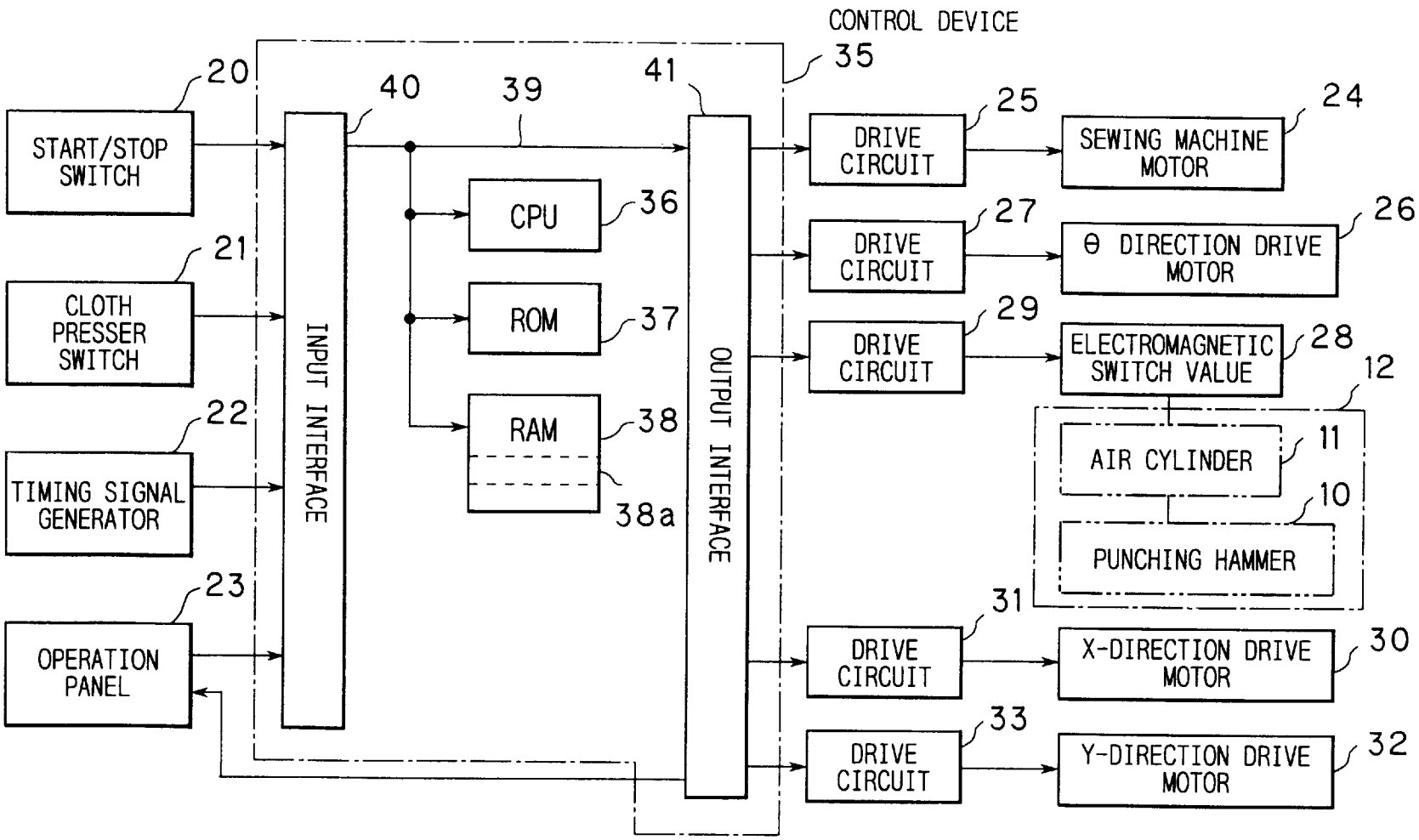
FIG. 3 is a block diagram showing a control device and electronic connection of components of the sewing machine.
Figure 6:
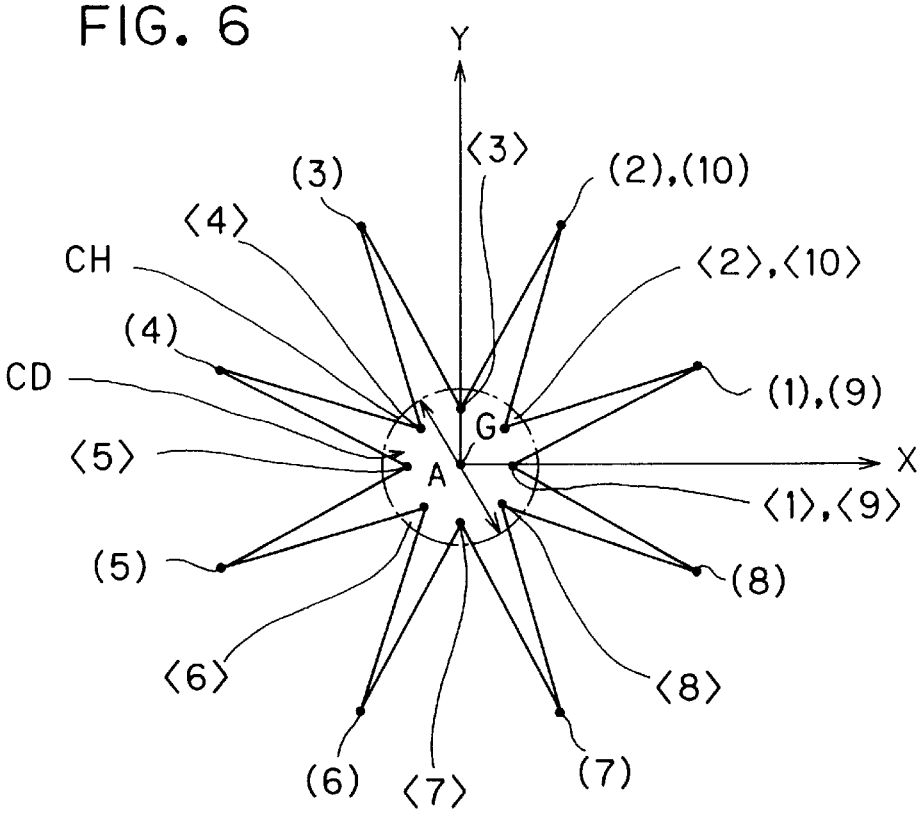
FIG. 6 is a schematic view showing a standard circular hole seam.

A lower knife 9 is replaceably fixed in the bed portion 1 at a position retracted behind the looper base 6. A punch-out hammer 10 is swlngably disposed on the arm portion 2 at a position in confrontation with the lower knife 9. The punch-out hammer 10 is pivotable away from and toward the lower knife 9. As shown in FIG. 3, a hammer drive mechanism 12, including an air cylinder 11 provided within the bed portion 1, is provided for driving the punch-out hammer 10. The punch-out haxmer 10 operates in cooperation with the lower knife 9 to cut button holes in the workpiece cloth. The button holes may be a circular pattern as shown in FIG. 6, an eyelet pattern as shown in FIG. 12, or straight slit-like pattern.

The feed bar 13 on which the workpiece cloth is set is provided on the upper surface of the bed portion 1. The feed bar 13 is formed in a thin rectangular box shape. The portion at the lower surface of the feed bar 13 in confrontation with the looper base 6 and the lower knife 9 is opened. As shown in FIG. 2, a metal cross plate 14 having an open portion 14*a* is provided on the upper surface of the feed bar 13. An X direction movement mechanism (not shown in the drawings) and a Y direction movement mechanism (not shown in the drawings) are provided internally in the bed portion 1. The X direction movement mechanism is for moving the feed bar 13 in an X direction, that is, leftward and rightward, by drive of an X direction drive motor 30. The Y direction movement mechanism is for moving the feed bar 13 in a Y direction, that is, frontward and rearward and perpendicular to the X direction, by drive of a Y direction drive motor 32. It should be noted that a cloth presser (not shown in the drawings) is provided to the metal cross plate 14 in order to press down the workpiece cloth at positions leftward and rightward of the open portion 14*a*.

The button holer sewing machine M is placed on a sewing machine table 16. An operation panel 23 for setting hole-sewing basic data, such as a diameter of a circular seam to be sewn, is provided on the sewing machine table 16. As shown in FIG. 3, a sewing machine motor 24 serving as a drive source for a drive mechanism for driving the needle bar 4 and the looper 6*a* in synchronization and a foot pedal type start/stop switch 20 are provided to the sewing machine table 16. Also, a control device 35, such as a microcomputer, for controlling drives of various components of the button holer sewing machine M is provided to the sewing machine table 16.

Next, a description for the control system of the button holer sewing machine M will be provided while referring to a block diagram of FIG. 3.

The control device 35 of the button holer sewing machine H includes a microcomputer, an input interface 40, and an output interface 41. The microcomputer includes a CPU 36, a ROM 37, and a RAM 38. The input interface 40 and the output interface 41 are connected to the microcomputer by a bus 39 such as a data bus. The input interface 40 is connected so as to receive signals inputted from the start/stop switch 20, a cloth presser switch 21 connected to the cloth presser, a timing signal generator 22, and the operation panel 23.

The output interface 41 is connected to the operation panel 23 and also to a variety of drive circuits, including: a drive circuit 25 for driving the sewing machine motor 24: a drive circuit 27 for driving the θ direction drive motor 26: a drive circuit 29 for driving an electromagnetic switching valve 28, which is for driving the air cylinder 11 provided to the hammer drive mechanism 12; a drive circuit 31 for driving the X direction drive motor 30; and a drive circuit 33 for driving the Y direction drive motor 32. The output interface 41 outputs drive signals and drive pulse signals to the drive circuits and to the operation panel 23. In the present embodiment, the X direction drive motor 30 and the Y direction drive motor 32 are configured from stepping motors. The timing signal generator 22 is provided to operate in linking connection with the main shaft 5 of the button holer sewing machine M. The timing signal generator 22 detects rotational phase of the main shaft 5 and outputs a phase signal accordingly.

The ROM 37 stores drive control programs for controlling the sewing machine motor 24. the motors 26, 30, 32, and the electromagnetic switching valve 28. The ROM 37 also stores control programs for controlling hole sewing operations of the button holer sewing machine M. The RAM 38 is provided with a variety of memories and buffers including a seam data memory 38*a* for storing seam data of a hole or other patterns to be produced.

Figure 4:
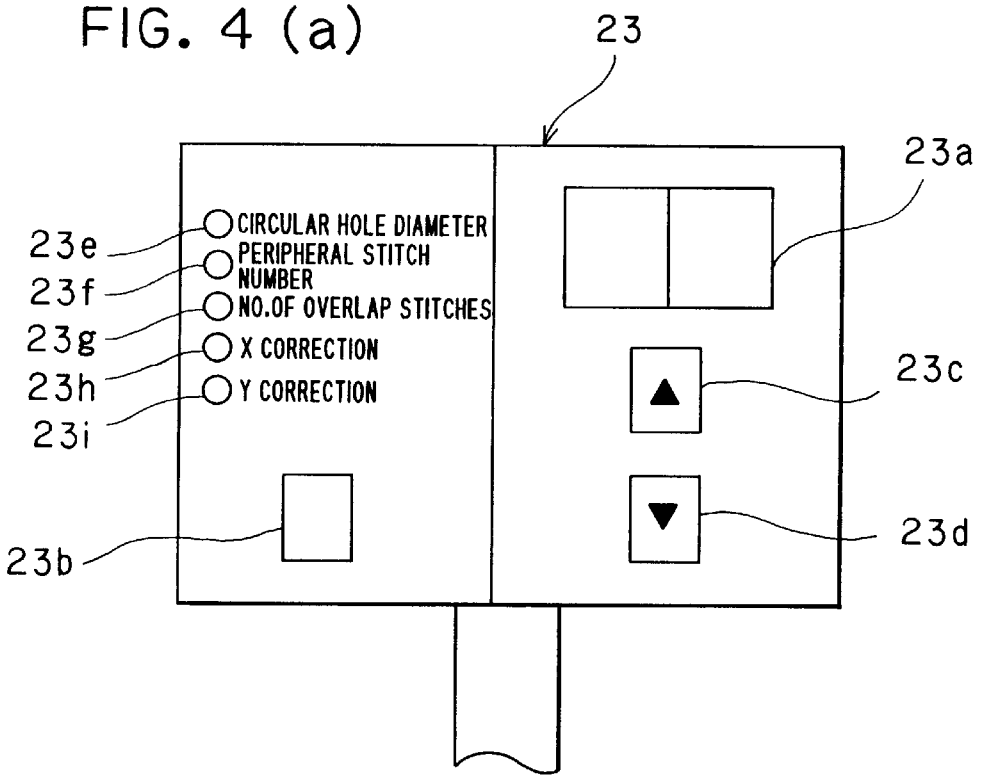
FIG. 4(*a*) is a plan view showing a control panel of the sewing machine used for a first embodiment of the present invention.
Figure 4:
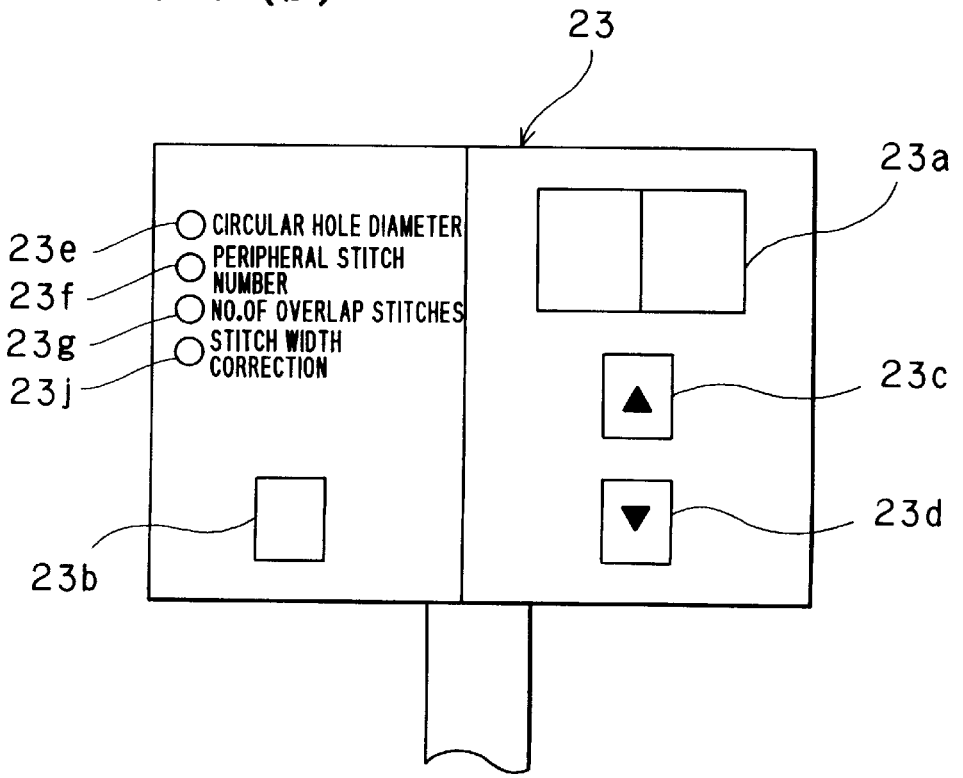
Figure 4:
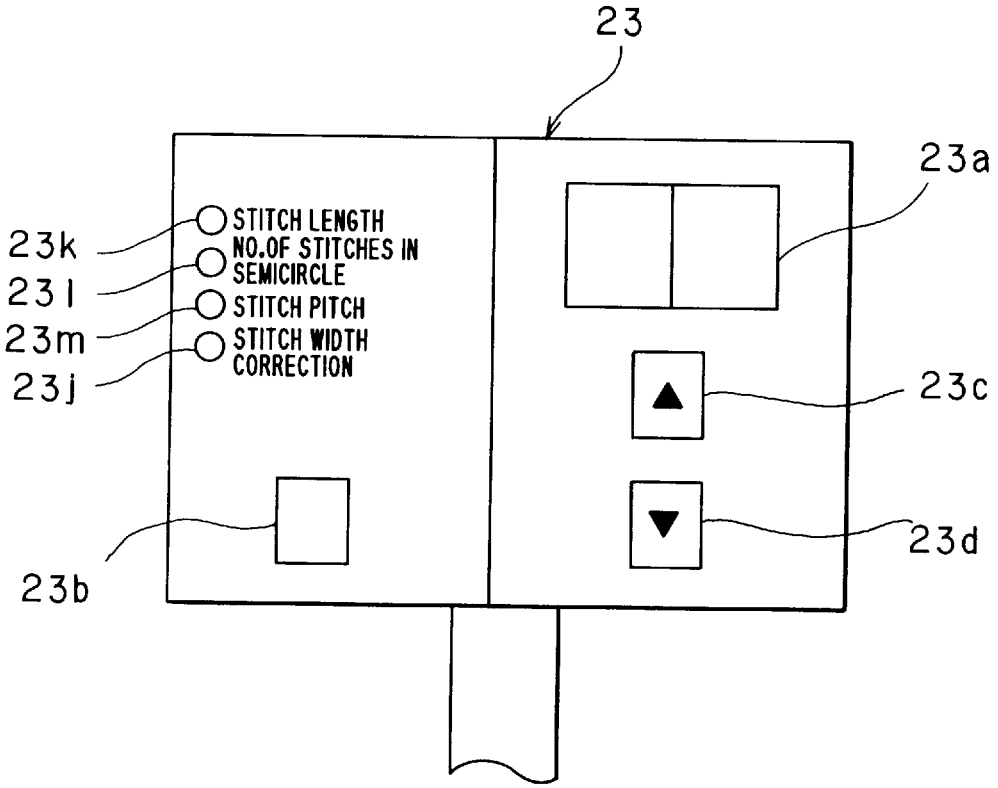

As shown in FIG. 4(*a*), the operation panel 23 used in the first embodiment includes a circular hole diameter indication lamp 23*e*, a peripheral stitch number indication lamp 23*f*, an overlap stitch number indication lamp 23*g*, an X correction indication lamp 23*h*, and a Y correction indication lamp 23*i*. The indication lamps 23*e* through 23*i* are for indicating which type of basic data for sewing a desired hole is to be inputted. A selector key 23*b* is provided to enable the user to switch from one basic data category to another in order to input desired values for each category. A liquid crystal display (LED) 23*a* is provided for displaying inputted values for each selected category. A value up key 23*c* is provided for increasing an inputted value. A value down key 23*d* is provided reducing an inputted value. When the user selects a category using the selector key 23*b*, the appropriate one of the correction indication lamps 23*e* through 23*i* illuminates.

Figure 7:
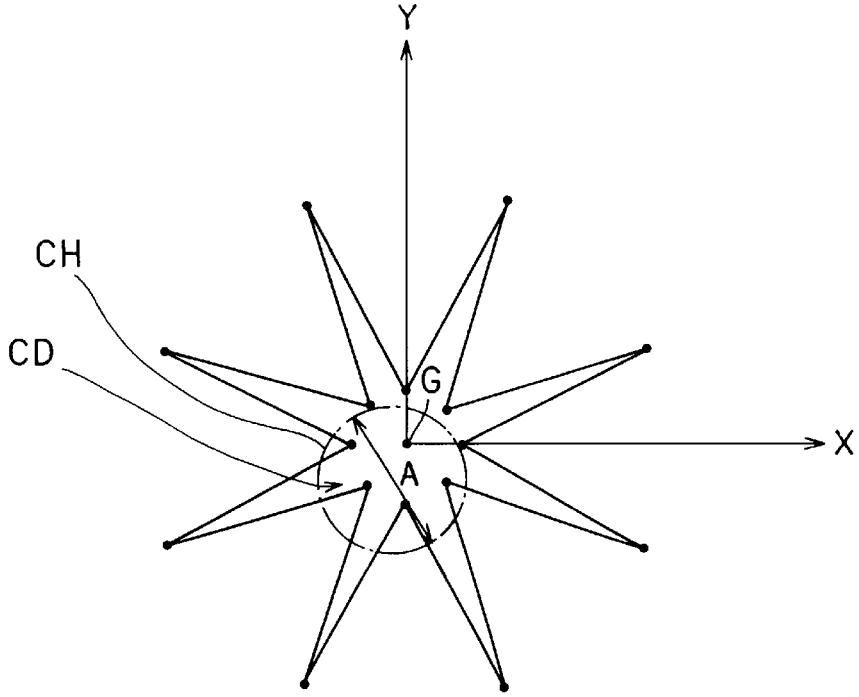
FIG. 7 is a schematic view showing a circular hole seam with poor appearance.
Figure 8:
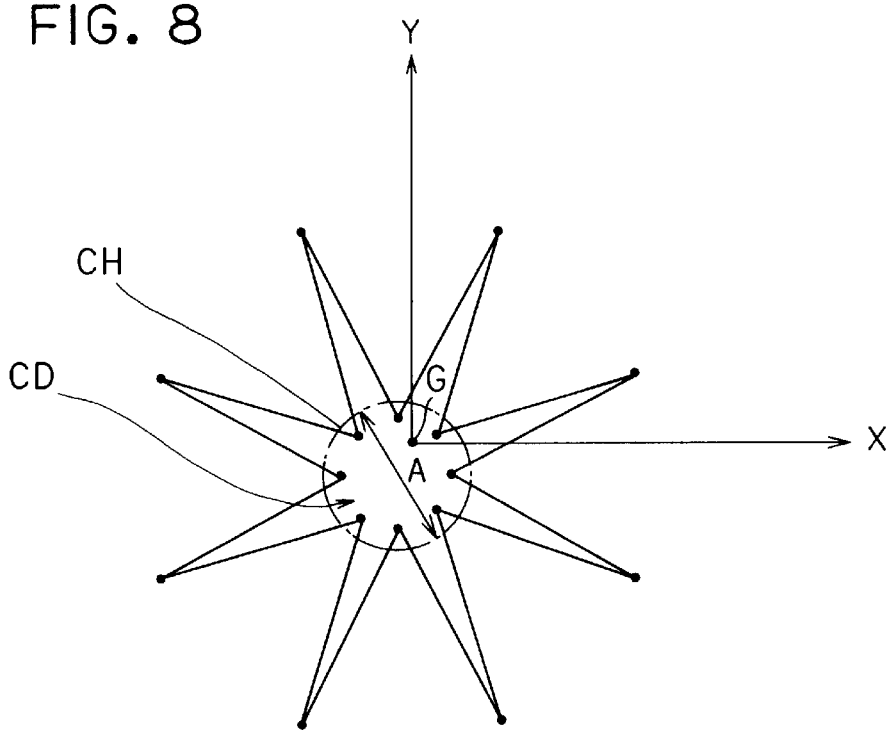
FIG. 8 is a schematic view showing the circular hole seam of FIG. 7 corrected using the routine represented by the flowchart of FIG. 5(*a*)

Now, a first embodiment of the present invention will be described while referring to the flowchart in FIG. 5(*a*) and diagrams shown in FIGS. 7 and 8. FIG. 7 shows an example of a circular hole seam with poor appearance because the hole is off center of the surrounding seam. FIG. 8 shows a circular hole seam with good appearance. The first embodiment is directed to correction of the seams shown in FIG. 7 to those shown in FIG. 8. In the flowchart in FIG. 5(*a*) and the accompanying text, individual steps will be referred to as Si (i=11, 12, . . . ). Before a routine represented by the flowchart in FIG. 5(*a*) is started, the user operates the operation panel to set basic data for the sewing operation. In this embodiment, it will be assumed that the circular hole diameter is A, the peripheral stitch number is B, the overlap stitch number is C, the X correction in δ X, and the Y correction is δ Y.

Each time the main shaft 5 rotates once, the sewing needle 3 swings from its leftmost swing position (inner stitch position), where it is driven vertically to form a stitch, and to its rightmost swing position (outer stitch position), where again it is driven vertically to form a stitch. Then, the needle bar 4 is rotated once by a rotation angle T. Therefore, after the routine starts, in S10, rotation angle T is determined using the following formula, which angle corresponds to half the serially sewn inner and outer stitches:

$$T=360°/2B$$

Next in S11, the stitch number j is set to an initial value of 1. Then in S12, the inner stitch position is calculated for each stitch number j. Next in S13, the outer stitch position is calculated for each stitch number j.

In the first embodiment, the stitch positions are determined in S12 and S13 by determining X-Y coordinates of the circular portion CD shown in FIG. 6. The circular portion CD has a center G, which serves as the origin for the X-Y coordinates. The diameter A of the circular portion CD set in correspondence with a peripheral portion of a circular hole CH punched in the workpiece cloth. In FIG. 6, the inner stitch positions for each stitch are indicated by <1>, <2>, <3> and so on. The outer stitch positions for each stitch are indicated by (1), (2), (3) and so on.

In S12, when calculating the inner stitch position corresponding to the stitch number j, the X direction stitch position X<j> along the x axis is determined by the following formula:

$$x<j>=(A/2)\times\cos\{(2j-2)\times T\}$$

The Y direction stitch position Y<j> corresponding to the stitch number j is determined by the following formula:

$$Y<j>=(A/2)\times\sin\{(2j-2)\times T\}$$

Further, the rotation angle θ <j> of the needle bar 4 corresponding to the stitch number j is determined by the following formula:

$$\theta<j>=(2j-2)\times T$$

Then, values of X<j>, Y<j>, θ<j> are stored in the seam data memory 38*a* as inner stitch position data corresponding to the stitch number j.

On the other hand, in S13, when calculating the outer stitch position corresponding to the stitch number j, the X direction stitch position X(j) along the X axis is determined by the following formula:

$$x(j)=(A/2)\times\cos\{(2j-1)\times T\}$$

The Y direction stitch position Y(j) corresponding to the stitch number j is determined by the following formula:

$$Y(j)=(A/2)\times\sin\{(2j-1)\times T\}$$

Further, the rotation angle θ(j) of the needle bar 4 corresponding to the stitch number j is determined by the following formula:

$$\theta(j)=(2j-1)\times T$$

Then, values of X(j), Y(j), θ(j) are stored in the seam data memory 38*a* as outer stitch position data corresponding to the stitch number j.

Next, in S14, it is determined whether or not the stitch number j is less than the sum of the peripheral stitch number B and the overlap stitch number C. When the stitch number j is less than the total of the peripheral stitch number B and the overlap stitch number C (S14:YES), then in S15, the stitch number j is incremented by one and S12 to S15 are repeated so that the inner stitch position and the outer stitch position are determined for each stitch of the stitch number j. When all of the stitch positions have been determined so that the stitch number j equals the sum of the peripheral stitch number B and overlap stitch number C (S14:NO), then the routine precedes to S16, wherein the current stitch position is reset to be the point of origin and the absolute coordinates of the other stitches are converted into coordinates relative to the newly determined point of origin. Next in S17, a correction value is added to the inner stitch coordinate of the first stitch converted into a relative coordinate.

Operations performed in S17 can be represented by the following formulas:

$$X \text{ coordinate: } XX<1>=XX<1>+\delta X$$

$$Y \text{ coordinate: } YY<1>=YY<1>+\delta Y$$

$$\theta \text{ coordinate: } \theta\theta<1>=\theta\theta\delta<1>$$

wherein X, Y, and θ indicate absolute coordinates; and XX, YY, and θθ indicate relative coordinates.

The seam data of the relative coordinates XX<j>, YY<j>, and θθ<j> are stored in the seam data memory 38*a*.

Next, processes for sewing the circular portion CD will be described. First, the operator presses the cloth presser switch 21 and sets the workplace cloth on the feed bar 13. Next, the user operates the start/stop switch 20, whereupon the punch-out hammer 10 and the lower knife 9 operate in association to form a circular hole in the workplece cloth. Afterward, the feed bar 13 is moved to the sewing start position based on seam data stored in the seam data memory 38*a*. When the feed bar 13 is moved to the sewing position, the sewing machine motor 24 is started and sewing operations are started. During sewing operations, the X direction drive motor 30, Y direction drive motor 32, and the θ direction drive motor 26 are driven in synchronization based on seam data for each stitch including X direction movement amount XX(j), Y direction movement amount YY(j), and θ direction pivot amount θθ(j). After the final stitch of the sewing operation has been completed, the sewing machine motor 24 is stopped and the cloth presser is released. The feed bar 13 is automatically returned to the position where the workpiece cloth was originally set.

Figure 9:
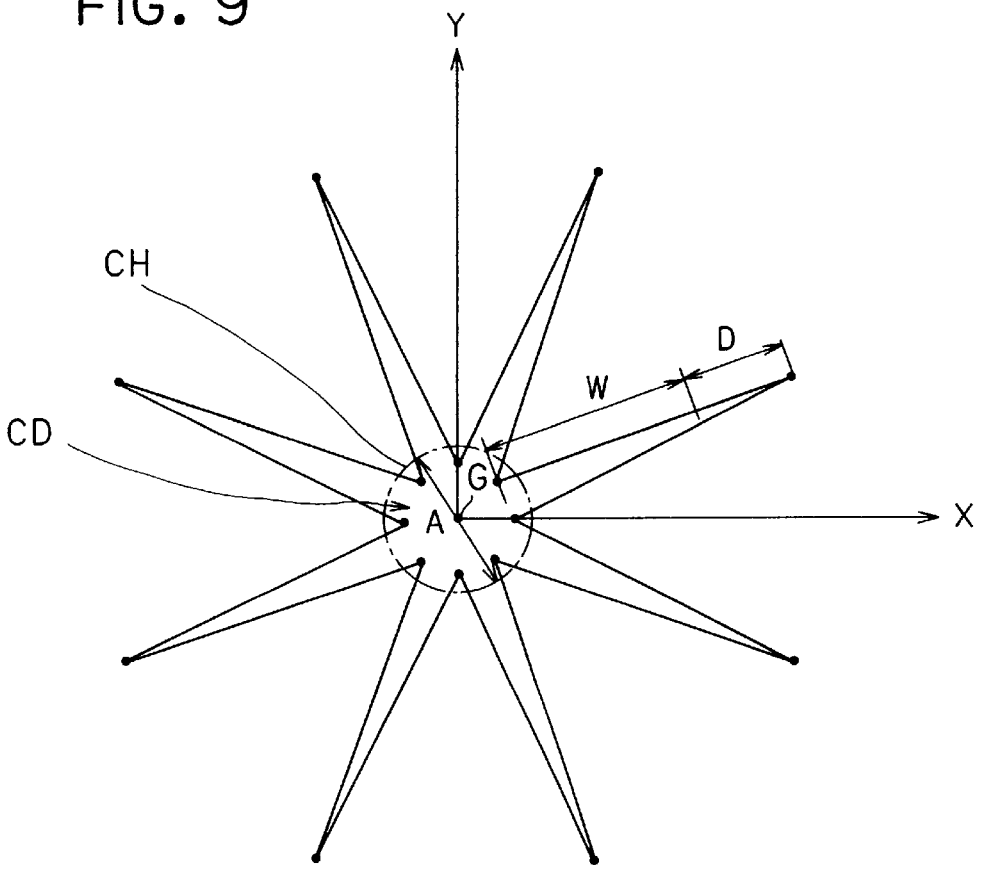
FIG. 9 is a schematic view showing the circular hole seam of FIG. 6 corrected using the routine represented by the flowchart of FIG. 5(*b*)

Next, a second embodiment of the present invention will be described while referring to the flowchart in FIG. 5(*b*) and the diagrams shown in FIGS. 6 and 9.

As shown in FIG. 4(*b*), the operation panel 23 used in the second embodiment is similar to that used in the first embodiment. The operation panel 23 used in the second embodiment includes a circular hole diameter indication lamp 23*e*, a peripheral stitch number indication lamp 23*f*, an overlap stitch number indication lamp 23*g*, and a stitch width correction indication lamp 23*j*. As in the operation panel used in the first embodiment, the indication lamps are for indicating which type of basic data for sewing a desired hole is to be inputted.

The second embodiment is directed to correction of the stitch width. Procedures for correcting the stitch width shown in FIG. 6 to that shown in FIG. 9 will be described while referring to the flowchart in FIG. 5(*b*). In the flowchart and the accompanying text, individual steps will be referred to as S1 (i=100, 111, . . . ).

Figure 5:
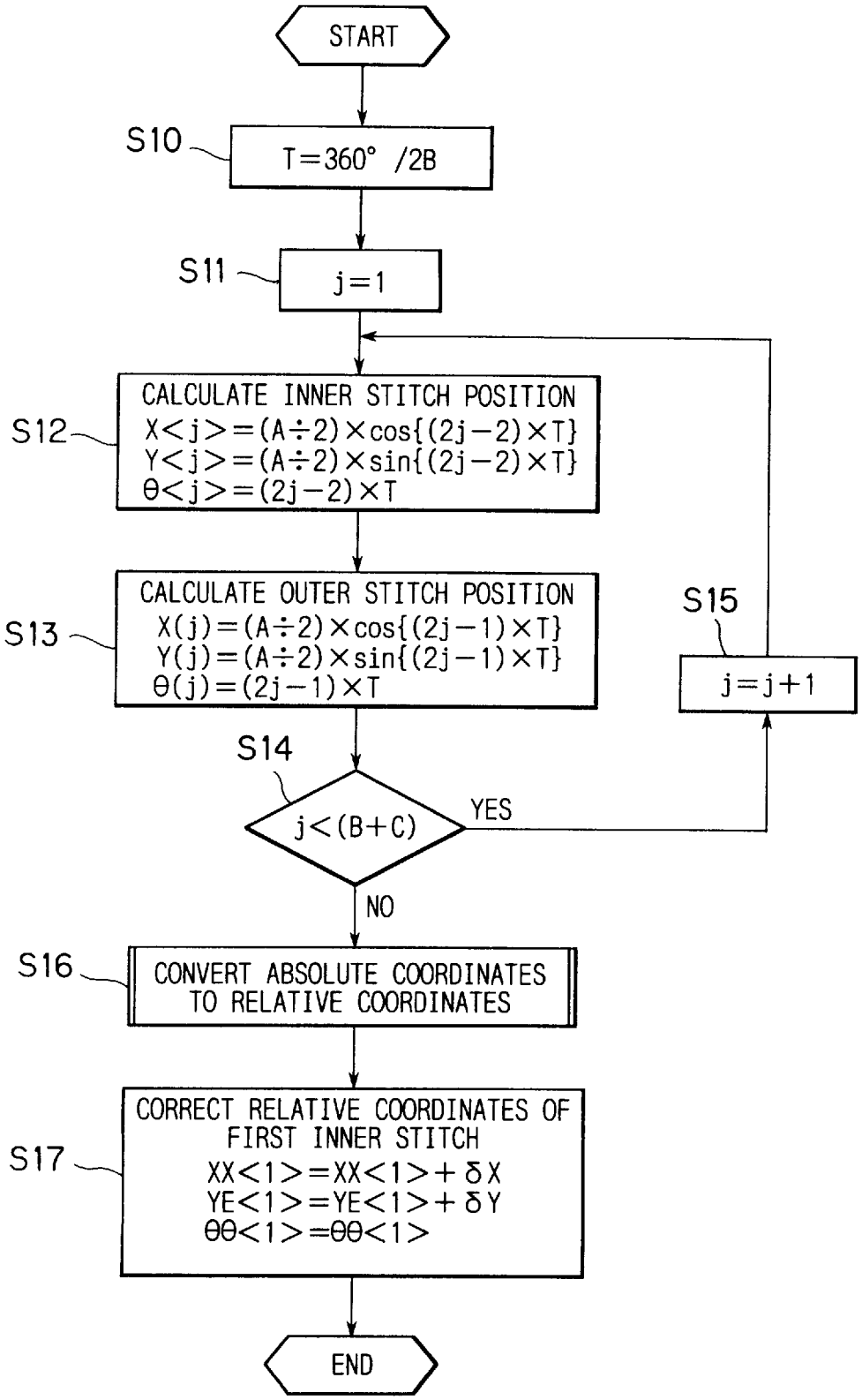
FIG. 5(*a*) is a flowchart representing a routine performed by the control device of the sewing machine according to the first embodiment of the present invention.
Figure 5:
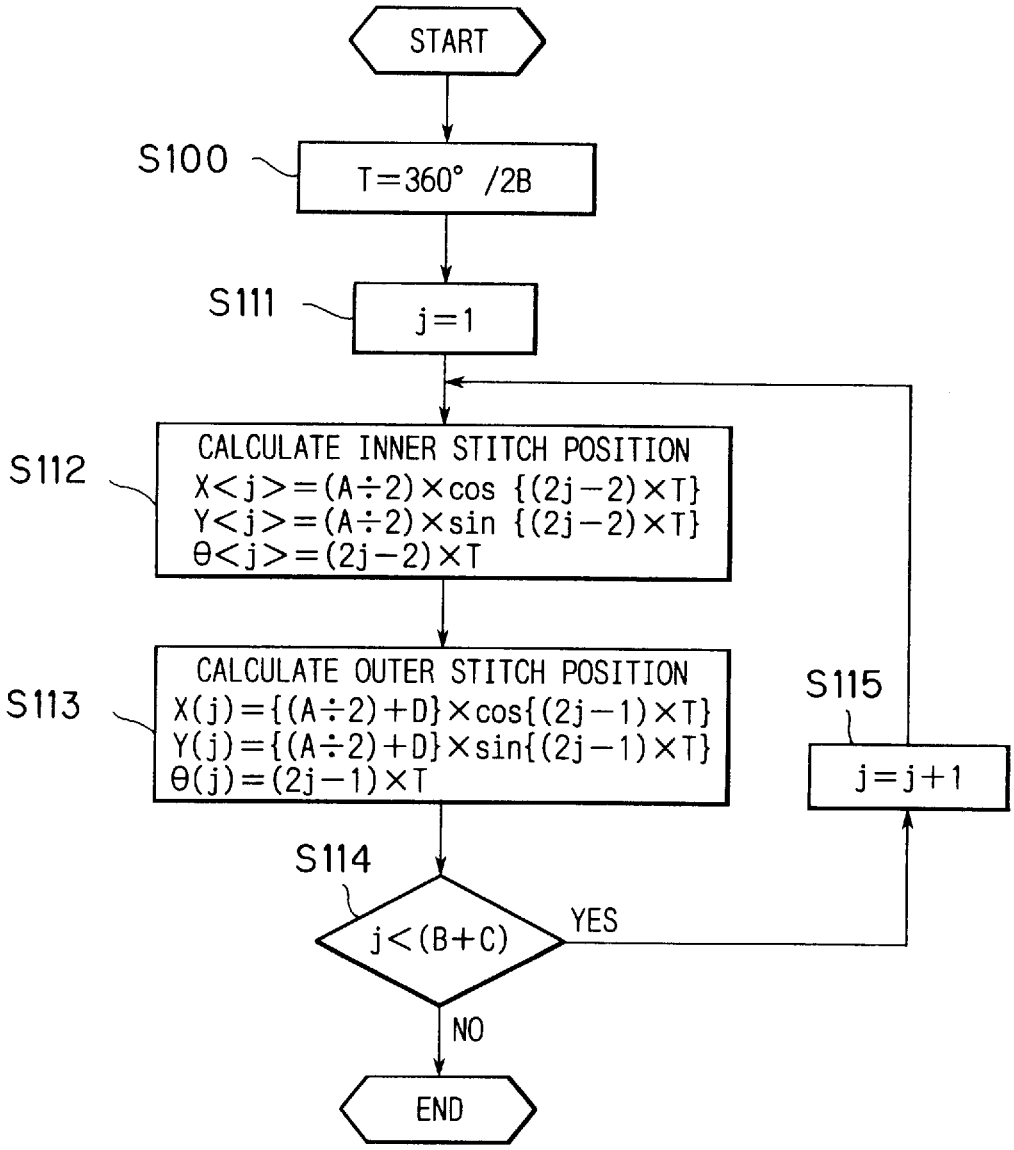
Figure 5:
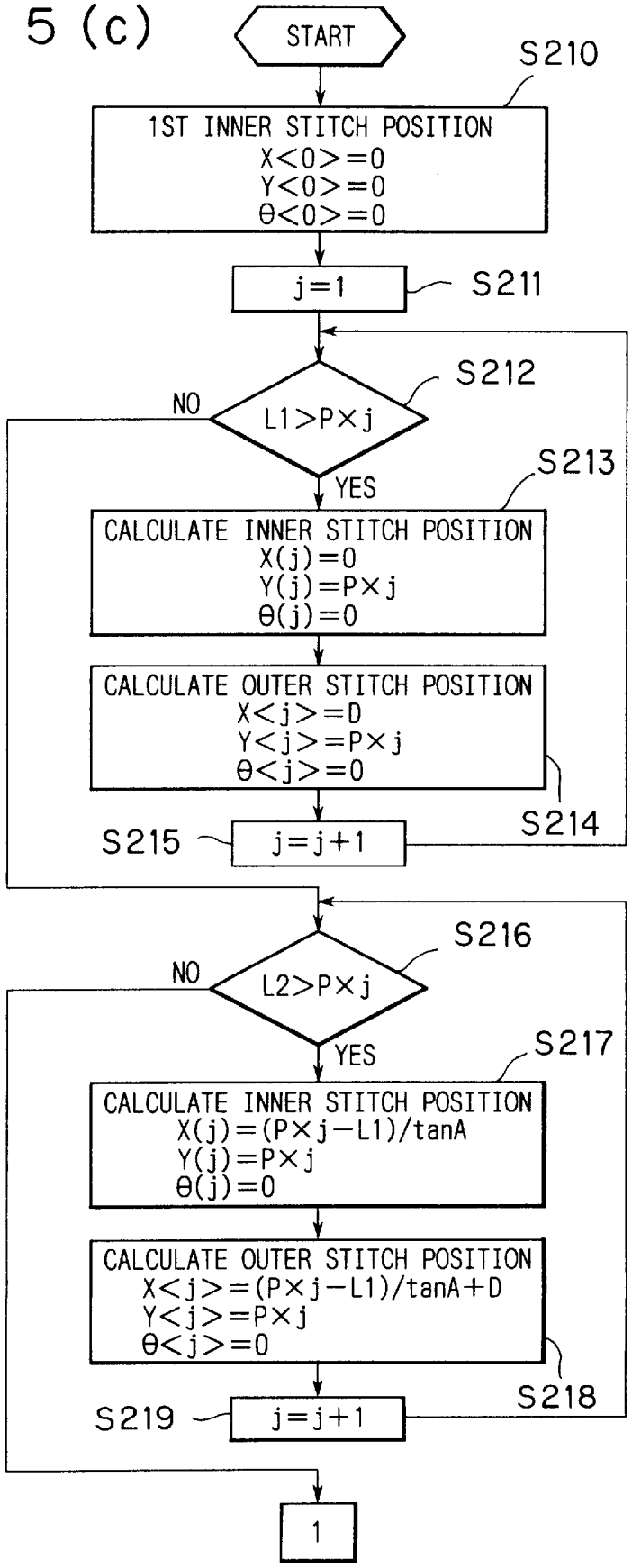
Figure 5:
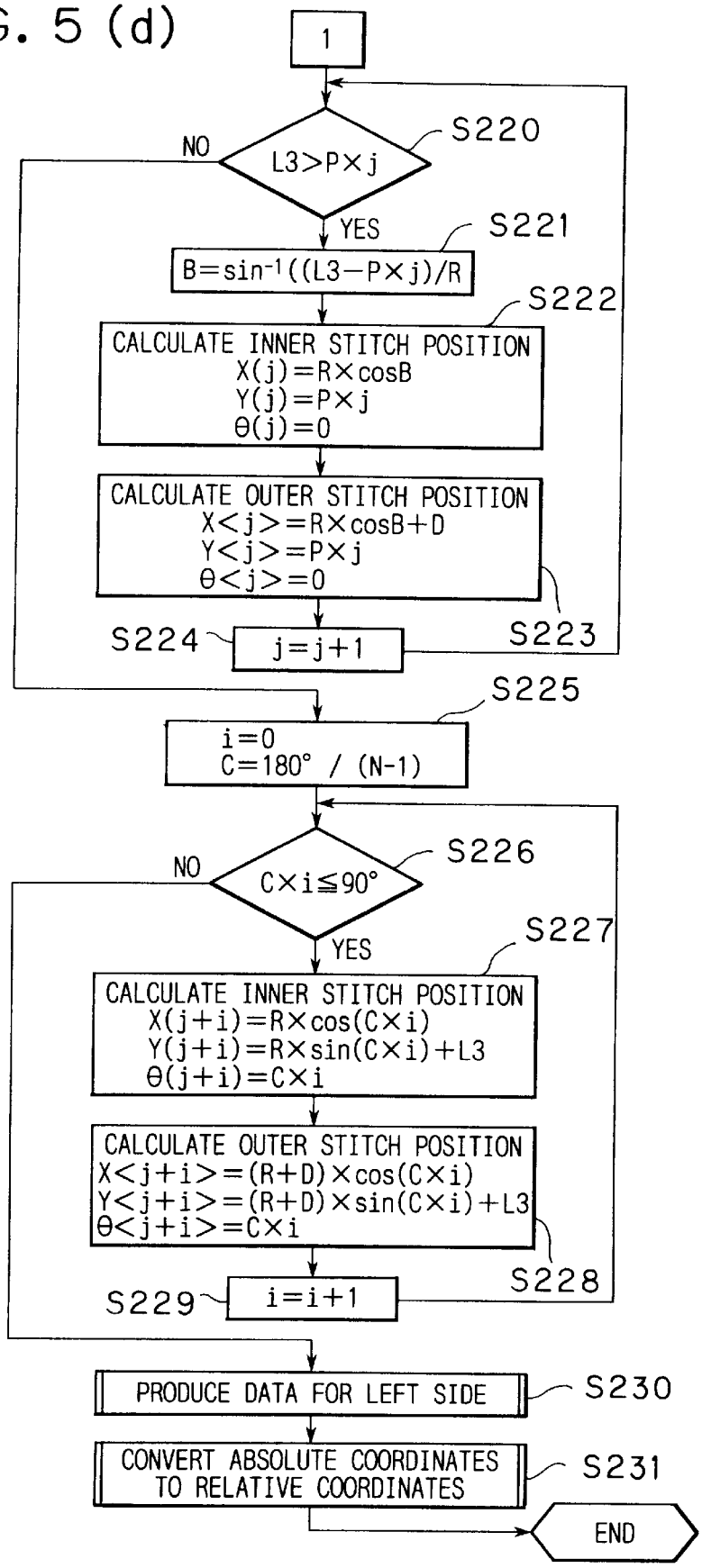

Before a routine represented by the flowchart in FIG. 5(*b*) is started, the user operates the operation panel to set basic data for the sewing operation. In this etbodiment, it will be assumed that the circular hole diameter is A, the peripheral stitch number is B, the overlap stitch number is C, and the stitch width correction is D. It will also be assumed that the pivot width of the needle bar 4 is W when stitching the standard circular hole seam shown in FIG. 6. Hence, in this embodiment. the stitch width for a circular hole is corrected from W to (W+D) as shown in FIG. 9.

Each time the main shaft 5 rotates once, the sewing needle 3 swings from its leftmost swing position (inner stitch position), where it is driven vertically to form a stitch, and to its rightmost swing position (outer stitch position), where again it is driven vertically to form a stitch. Then, the needle bar 4 is rotated once by a rotation angle T. Therefore, after the routine starts, in S100, rotation angle T is determined using the following formula, which angle corresponds to half the serially sewn inner and outer stitches:

$$T=360°/2B$$

Next in S111, the stitch number j is set to an initial value of 1. Then in S112, the inner stitch position is calculated for each stitch number j. Next in S113, the outer stitch position is calculated for each stitch number j.

Like the first embodiment, the stitch positions are determined in S112 and S113 by determining X-Y coordinates of the circular portion CD shown in FIG. 6. In S112, when calculating the inner stitch position corresponding to the stitch number j, the X direction stitch position X<j> along the X axis is determined by the following formula:

$$X<j>=(A/2)\times\cos\{(2j-2)\times T\}$$

The Y direction stitch position Y<j> corresponding to the stitch number j is determined by the following formula:

$$Y<j>=(A/2)\times\sin\{(2j-2)\times T\}$$

Further, the rotation angle θ<j> of the needle bar 4 corresponding to the stitch number j is determined by the following formula:

$$\theta<j>=(2j-2)\times T$$

Then, values of X<j>, Y<j>, θ<j> are stored in the seam data memory 38*a* as inner stitch position data corresponding to the stitch number j.

On the other hand, in S113, when calculating the outer stitch position corresponding to the stitch number j, the X direction stitch position X(j) along the X axis is determined by the following formula:

$$X(j)=\{(A/2)+D\}\times\cos\{(2j-1)\times T\}$$

The Y direction stitch position Y(j) corresponding to the stitch number j is determined by the following formula:

$$Y(j)=\{(A/2)+D\}\times\sin\{(2j-1)\times T\}$$

Further, the rotation angle θ(j) of the needle bar 4 corresponding to the stitch number j is determined by the following formula:

$$\theta(j)=(2j-1)\times T$$

Then, values of X(j), Y(j), θ(j) are stored in the seam data memory 38*a* as outer stitch positlon data corresponding to the stitch number j.

Next, in S114, it is determined whether or not the stitch number j is less than the sum of the peripheral stitch number B and the overlap stitch number C. When the stitch number j is less than the total of the peripheral stitch number B and the overlap stitch number C (S114:YES), then in S115, the stitch number j is incremented by one and S112 to S115 are repeated so that the inner stitch position and the outer stitch position are determined for each stitch of the stitch number j. When all of the stitch positions have been determined so that the stitch number j equals the sum of the peripheral stitch number B and overlap stitch number C (S114:NO), then the routine is ended.

Next, processes for sewing the circular portion CD will be described. First, the operator presses the cloth presser switch 21 and sets the workpiece cloth on the feed bar 13. Next, the user operates the start/stop switch 20, whereupon the punch-out hammer 10 and the lower knife 9 operate in association to form a circular hole in the workpiece cloth. Afterward, the feed bar 13 is moved to the sewing start position based on seam data stored in the seam data memory 38*a*. When the feed bar 13 is moved to the sewing position, the sewing machine motor 24 is started and sewing operations are started. During sewing operations, the X direction drive motor 30. Y direction drive motor 32, and the θ direction drive motor 26 are driven in synchronization based on the seam data for each stitch including the X direction stitch position X(j). Y direction stitch position Y(j), and the rotation angle θ(j). After the final stitch of the sewing operation has been completed, the sewing machine motor 24 is stopped and the cloth presser is released. The feed bar 13 is automatically returned to the position where the workpiece cloth was originally set. Through the operations described above, the switch width can be corrected from W to (W+D) as shown in FIG. 9.

In the second embodiment, the stitch width correction and the seam data production are carried out simultaneously. However, the stitch width correction may be made with respect to the seam data that is produced separately. Specifically, with the following formula, the same stitch width correction as that described above can be attained.

$$X(j)=X(j)+D\times\cos\{(2j-1)\times T\}$$

$$Y(j)=Y(j)+D\times\sin\{(2j-1)\times T\}$$

Finally, a third embodiment of the present invention will be described while referring to the flowchart in FIGS. 5(*c*) and 5(*d*) and the diagrams shown in FIGS. 10 and 11.

As shown in FIG. 4(*c*), the operation panel 23 used in the third embodiment includes a stitch length indication lamp 23*k*, a semicircle stitch number indication lamp 23*l*, a stitch pitch indication lamp 23*m*, and a stitch width correction indication lamp 23*j*. As in the operation panels used in the first and second embodiments, the indication lamps are for indicating which type of basic data for sewing a desired eyelet seam is to be inputted.

Like the second embodiment, the third embodiment is directed to correction of the stitch width. FIG. 10 shows an example of an eyelet button hole seam with a standard stitch width W. FIG. 11 shows an eyelet button hole seam with corrected stitch width (W+D) wherein D represents an amount of stitch width correction.

The eyelet button hole cut in the workpiece cloth consists of a straight line cut portion and an eyelet portion. As shown in FIGS. 10 and 11, the eyelet portion is semicircular in its upper half and triangular in its lower half. The eyelet button hole is stitched from the lowest cut position as viewed in FIG. 10 or 11 toward the eyelet portion. The finished seam is formed in the reverse surface of the workpiece cloth.

Figure 10:
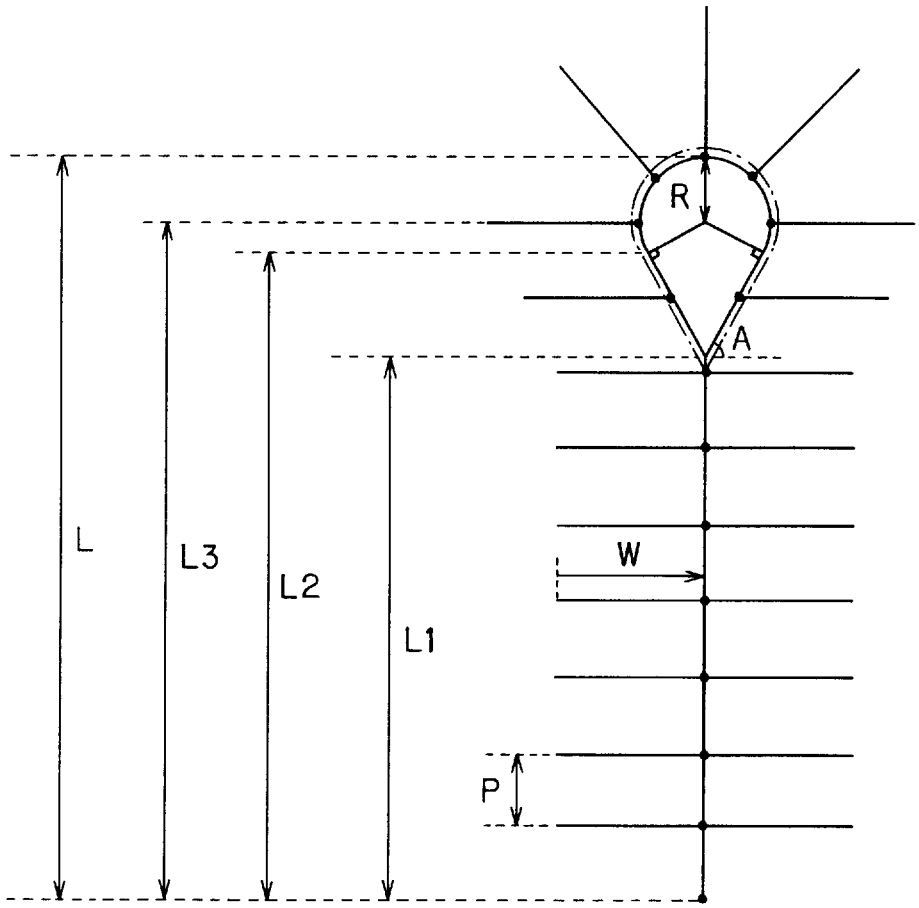
FIG. 10 is a schematic view showing a standard eyelet button hole seam.
Figure 11:
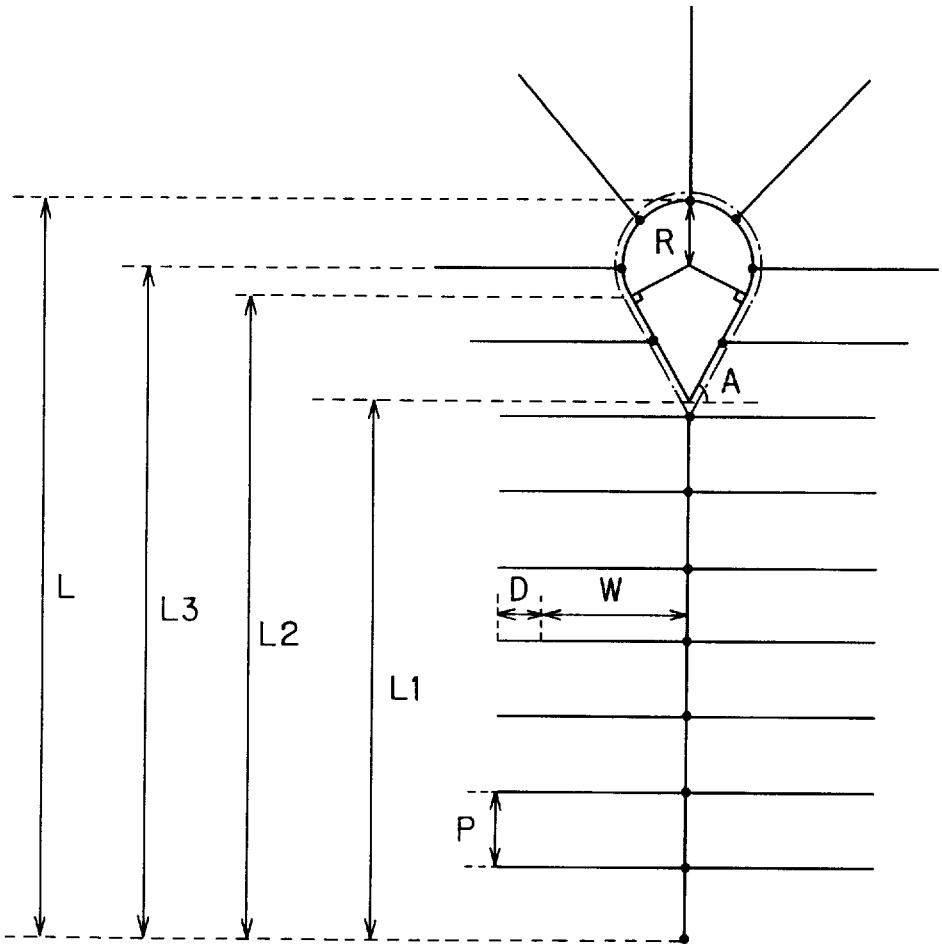
FIG. 11 is a schematic view showing the eyelet button hole seam of FIG. 10 corrected using the routine represented by the flowchart of FIGS. 5(*c*) and 5(*d*).

In FIGS. 10 and 11, P denotes the stitch pitch; A, a gradient of the line forming the lower half portion of the eyelet; R, a radius of the semicircle in the upper half of the eyelet portion; L, a stitching length; L1, a length from the stitch start position to the lower position of the eyelet portion; L2, a length from the stitch start position to the upper position of the triangle portion; and L3, a length from the stitch start position to the lower position of the semicircle portion. The lengths L1, L2 and L3 are determined based on the stitching length L and the configuration of the lower knife 9 used. The radius R and the gradient A are constant values determined dependent on the configuration of the lower knife 9.

Procedures for correcting the stitch width shown in FIG. 10 to that shown in FIG. 11 will be described while referring to the flowchart in FIGS. 5(*c*) and 5(*d*). In the flowchart and the accompanying text, individual steps will be referred to as S1 (i=200, 211, . . . ). Because the eyelet button hole has a symmetrical configuration, data production for the left half of the eyelet button hole can be performed in the same manner as the data production for the right half of the eyelet button hole. The following description will be made with respect only to the seam formed to the right half of the eyelet button hole for the sake of brevity.

Each time the main shaft 5 rotates once, the sewing needle 3 swings from its leftmost swing position (inner stitch position), where it is driven vertically to form a stitch, and to its rightmost swing position (outer stitch position), where again it is driven vertically to form a stitch. Then, the needle bar 4 is rotated once by a rotation angle T. Therefore. after the routine starts, in S210, the initial inner stitch position is determined. Next in S211, the stitch number j is set to an initial value of 1. Then in S212, it is determined whether or not the stitching is to be performed within the straight line region. If determination made in S212 indicates that stitching is to be performed in the straight line region (S212: Yes), then the inner and outer stitch positions corresponding to the stitch number j are calculated (S213, S214), whereupon the stitch number j is incremented by one (S215) and S212 through S215 are repeated until the determination made in S212 becomes negative. The negative determination made in S212 indicates that stitching in the straight line region is complete.

Then in S216, it is determined whether or not the stitching is to be performed within the triangle portion. If determination made in S216 indicates that stitching is to be performed in the triangle portion (S216: Yes), then the inner and outer stitch positions corresponding to the stitch number j are calculated (S217, S218), whereupon the stitch number j is incremented by one (S219) and S216 through S219 are repeated until the determination made in S216 becomes negative. The negative determination made in S216 indicates that stitching in the triangle portion is complete.

In S220, it is determined whether or not stitching is to be performed in the semicircle portion. If determination made in S220 indicates that the stitching is to be performed in the semicircle portion (S220: Yes), then a stitch angle B on the periphery of the semicircle where stitching corresponding to the stitch number j is performed is calculated according to the following formula.

$$B=\sin^{-1}\{(L3-P\times j)/R\}$$

Next, the inner and outer stitch positions corresponding to the stitch number j are calculated (S222, S223), whereupon the stitch number j is incremented by one (S224) and S220 through S224 are repeated until the determination made in S220 becomes negative. The negative determination made in S220 indicates that stitching in the semicircle portion is complete.

Next, stitch width correction will be carried out in S225 through 229. In S225, a number i is set to an initial value of 0 (zero). Also, a rotation angle C of the θ axis for one stitch is obtained by the following formula:

$$C=180°/(N-1)$$

where N represents the number of stitches across the periphery of the semicircle. The number N is set through the operation panel 23. When the stitching is to be performed in the rightside of the semicircle portion (S226: Yes), then the inner and the outer stitch positions are calculated by the following formula:

As to the inner stitch position, $$X(j+i)=R\times\cos(C\times i)$$

$$Y(j+i)=R\times\sin(C\times i)+L3$$

$$\theta(J+1)=C\times i$$

and as to the outer stitch position, $$X<j+i>=(R+D)\times\cos(C\times i)$$

$$Y<j+i>=(R+D)\times\sin(C\times i)+L3$$

$$\theta<j+i>=c\times i$$

Next, i is incremented by one and S226 through S229 are repeated until the determination made in S226 becomes negative. When the determination made in S226 becomes negative, then the leftside data are produced in the similar manner as is done for rightside (S230). Then, the absolute coordinates are converted into relative coordinates (S231) as described with respect to the first embodiment, whereupon the routine is ended.

While the invention has been described in detail with reference to specific embodiments thereof, it would be apparent to those skilled in the art that various changes and modifications may be made therein without departing from the spirit of the invention, the scope of which is defined by the attached claims.

For example, the above-described embodiments were described for sewing circular holes and eyelets. However, the present invention could be used to sew holes of other pattern, such as straight slit-like button holes.

What is claimed is:

1. A button holer sewing machine comprising:

a feed bar on which a workpiece cloth is set, said feed bar being movable horizontally on an X-Y plane defined by an X direction and a Y direction perpendicular to the X direction;

an opening forming mechanism including a blade and a hammer for forming an opening at a position in the workpiece cloth;

a needle bar to which a needle is attached, said needle bar and said needle being generally vertically movable from an upper position to a lower position;

a feed mechanism that moves said feed bar on the X-Y plane when said needle bar is in its upper position;

a looper base provided with a looper, a seam being formed in a workpiece cloth by said looper and said needle in cooperation with each other;

a drive mechanism that simultaneously drives said needle bar and said looper to perform seam forming operations;

a rotation mechanism that rotates said needle bar and said looper base about a vertical axis;

a control device that controls said rotation mechanism, said feed mechanism and said drive mechanism based on seam data designating, for each stitch, a rotation angle of said needle bar and said looper base, and a feed amount of said feed bar represented by an X value and Y value on the X-Y plane;

an X-correction value input unit for inputting an X-correction value;

a Y-correction value input unit that inputs a Y-correction value; and a seam data correction unit that corrects the seam data based on the X correction value input by said X-correction value input unit and the Y-correction value input bv said Y-correction value input unit, whereby with the stitch data corrected by said seam data correction unit, a seam position in the X-direction can be corrected with respect to the position of the opening formed by said opening forming mechanism.

2. The button holer sewing machine according to claim 1, further comprising a motor, a main shaft rotated by said motor, and a pivot mechanism that translates rotations of said main shaft to a pivotal movement, causing said needle to pivotally move between inner and outer positions on the X-Y plane with respect to a boundary of the circular hole.

3. The button holer sewing machine according to claim 1, further comprising a stitching information input unit for inputting basic information that defines the seam to be formed in the workplace cloth, and a seam data producing unit that produces the seam data based on the basic information input by said stitching information input unit.

4. The button holer sewing machine according to claim 3, wherein said stitching information input unit and said x-correction value input unit are formed as a single unit.

5. The button holer sewing machine according to claim 3, wherein said stitching information input unit, said X-correction value input unit, and said Y-correction value input are formed as a single unit.

6. The button holer sewing machine according to claim 2, wherein said blade is detachably provided, thereby allowing any one of different shape openings to be formed on the workpiece cloth.

7. The button holer sewing machine according to claim 3, wherein when the opening formed in the workpiece cloth by said opening forming mechanism is a circular hole, the basic information input by said stitching information input unit includes a diameter of the circular hole, peripheral stitch number indicating a number of stitches formed along a periphery of the circular hole. and overlap stitch number indicating a number of stitches overlapped in the periphery of the circular hole.

8. The button holer sewing machine according to claim 7, wherein said seam data producing unit produces the seam data defined by;

$$X<j>=(A/2)\times\cos\{(2j-2)\times T\}$$

$$Y<j>=(A/2)\times\sin\{(2j-2)\times T\}$$

$$\theta<j>=(2j-2)\times T$$

$$X(j)=(A/2)\times\cos\{(2j-1)\times T\}$$

$$Y(j)=(A/2)\times\sin\{(2j-1)\times T\}$$

$$\theta(j)=(2j-1)\times T$$

wherein X<j> represents an X coordinate value on the X-Y plane of the inner position corresponding to a stitch number j. Y<j> represents a Y coordinate value on the X-Y plane of the inner position corresponding to the stitch number j, θ <j> represents a rotation angle of said needle bar and said looper base corresponding to the stitch number j when the inner position is stitched. X(j) represents an X coordinate value on the X-Y plane of the outer position corresponding to the stitch number j, Y(j) represents a Y coordinate value on the X-Y plane of the outer position corresponding to the stitch number j, θ(j) represents a rotation angle of said needle bar and said looper base corresponding to the stitch number j when the outer position is stitched, A represents a diameter of the circular hole, and T is a rotation angle of said needle bar and said looper base for stitching the inner position and the outer position corresponding to a half a stitch.

9. The button holer sewing machine according to claim 8, further comprising a memory that stores values of X<j>, Y<j>, θ<j>, X(j), Y(j), and θ(j).

10. The button holer sewing machine according to claim 9, wherein said X-correction value input unit adds the X-correction value to each of the values of X<j> and X(j) corresponding to an initial stitch number, and said Y-correction value input unit adds the Y-correction value to each of the values of Y<j> and Y(j) corresponding to the initial stitch number.

11. The button holer sewing machine according to claim 10, wherein said memory further stores the seam data corrected by said seam data correction unit.

12. A button holer sewing machine comprising:

a feed bar on which a workpiece cloth is set, said feed bar being movable horizontally on an X-Y plane defined by an X direction and a Y direction perpendicular to the X direction;

an opening forming mechanism including a blade and a hammer for forming an opening at a position in the workpiece cloth;

a needle bar to which a needle is attached, said needle bar and said needle being generally vertically movable from an upper position to a lower position;

a feed mechanism that moves said feed bar on the X-Y plane when said needle bar is in the upper position;

a looper base provided with a looper, seams being formed in the workpiece cloth by said looper and said needle in cooperation with each other;

a drive mechanism that simultaneously drives said needle bar and said looper to perform seam forming operations;

a pivot mechanism that translates rotations supplied from a main shaft to a pivotal movement, causing said needle to pivotally move between inner and outer positions on the X-Y plane with respect to a boundary of the opening;

a rotation mechanism that rotates said needle bar and said looper base about a vertical axis;

a control device that controls said rotation mechanism, said feed mechanism and said drive mechanism based on seam data designating, for each stitch, a rotation angle of said needle bar and said looper base and a feed amount of said feed bar represented by an X value and Y value on the X-Y plane;

a stitch width correction input unit that inputs a correction of a stitch width of the seam determined by the inner and outer positions to which said needle pivotally moves; and a seam data correction unit that corrects the seam data based on the stitch width of the seam input by said stitch width correction input unit.

13. The button holer sewing machine according to claim 13, further comprising a stitching information input unit for inputting basic information that defines the seam to be formed in the workpiece cloth, and a seam data producing unit that produces the seam data based on the basic information input by said stitching information input unit.

14. The button holer sewing machine according to claim 13, wherein said stitching information input unit and said stitch width correction input unit are formed as a single unit.

15. The button holer sewing machine according to claim 12, wherein said blade is mounted detachably, thereby allowing any one of different shape openings to be formed on the workplace cloth.

16. The button holer sewing machine according to claim 13, wherein when the opening formed in the workpiece cloth by said opening forming mechanism is a circular hole, the basic information input by said stitching information input unit includes a diameter of the circular hole, peripheral stitch number indicating a number of stitches formed along a periphery of the circular hole, and overlap stitch number indicating a number of stitches overlapped in the periphery of the circular hole.

17. The button holer sewing machine according to claim 16, wherein said seam data producing unit produces the seam data defined by:

$$X<j>=(A/2)\times\cos\{(2j-2)\times T\}$$

$$Y<j>=(A/2)\times\sin\{(2j-2)\times T\}$$

$$\theta<j>=(2j-2)\times T$$

$$X(j)=(A/2)\times\cos\{(2j-1)\times T\}$$

$$Y(j)=(A/2)\times\sin\{(2j-1)\times T\}$$

$$\theta(j)=(2j-1)\times T$$

wherein X<j> represents an X coordinate value, on the X-Y plane of the inner position corresponding to a stitch number j, Y<j> represents a Y coordinate value on the X-Y plane of the inner position corresponding to the stitch number j, θ <j> represents a rotation angle of said needle bar and said looper base corresponding to the stitch number j when the inner position in stitched, X(j) represents an X coordinate value on the X-Y plane of the outer position corresponding to the stitch number j, Y(j) represents a Y coordinate value on the X-Y plane of the outer position corresponding to the stitch number j, θ(j) represents a rotation angle of said needle bar and said looper base corresponding to the stitch number j when the outer position is stitched, A represents a diameter of the circular hole, and T is a rotation angle of said needle bar and said looper base for stitching the inner position and the outer position corresponding to a half a stitch.

18. The button holer sewing machine according to claim 17, further comprising a memory that stores values of X<j>, Y<j>, θ<j>, X(j), Y(j), and θ(j).

19. The button holer sewing machine according to claim 18, wherein said seam data correction unit produces corrected seam data represented by $$X(j)=\{(A/2)+D\}\times\cos\{(2j-1)\times T\}$$

$$Y(j)=\{(A/2)+D\}\times\sin\{(2j-1)\times T\}$$

wherein D represents the stitch width input by said stitch width correction input unit.

* * * * *